United States Patent [19]

Donohue

[11] Patent Number: 4,641,952

[45] Date of Patent: Feb. 10, 1987

[54] SELECTIVE DEVELOPMENT CONTROL FOR ELECTROSTATIC REPRODUCTION MACHINES

[75] Inventor: James M. Donohue, Rochester, N.Y.

[73] Assignee: Xerox Corporation, Stamford, Conn.

[21] Appl. No.: 145,013

[22] Filed: May 19, 1971

Related U.S. Application Data

[63] Continuation of Ser. No. 731,967, May 24, 1968, abandoned.

[51] Int. Cl.[4] ..... G03G 15/02

[52] U.S. Cl. ..... 355/14 R

[58] Field of Search ..... 355/3 R, 14 R

[56] References Cited

U.S. PATENT DOCUMENTS

| | | | |
|---|---|---|---|
| 1,734,780 | 11/1929 | Simjian | 355/89 |
| 2,891,443 | 6/1959 | Pollock | 355/19 |
| 2,927,516 | 3/1960 | Hix | 355/6 |
| 3,147,679 | 9/1964 | Schaffert | 355/3 |
| 3,556,655 | 1/1971 | Lux | 355/55 |

*Primary Examiner*—Fred L. Braun

*Attorney, Agent, or Firm*—Bernard A. Chiama

[57] ABSTRACT

A control system for use with an electrostatic developing system of a reproduction machine that normally remains in developing condition during machine operation. The control includes a lamp and circuit therefor which becomes energized to dissipate the charge on a photoconductive surface at those times and places thereon where developing is not to occur.

3 Claims, 3 Drawing Figures

SELECTIVE DEVELOPMENT CONTROL FOR ELECTROSTATIC REPRODUCTION MACHINES

This is a continuation of application Ser. No. 731,967, filed May 24, 1968, now abandoned.

This invention relates to electrostatic developing systems, and particularly, to improvements in the control of development with particulate toner material that is adapted for use with automatic copiers/reproducers capable of high speed operation.

As is well known in recent years, the steadily increasing size of various industries has required an enormous increase in the amount of paper work that must be accomplished, maintained, and made available for wide interplant circulation. In the present day commercial automatic copiers/reproduction machines, which are adapted to produce copies of between 5 and 60 8×11" sheets of copy per minute, the charging circuit for charging the photoreceptor device is such as to be periodically energized preparatory to exposure of an original being reproduced which requires relatively complicated circuitry to accomplish.

As a solution for overcoming many disadvantages for high speed copying, the latest machine concept for copiers utilizes flash exposure of a document and the arrangement of a moving photoconductor material in the form of an endless belt. However, there has been no effective way in which to control charging of the photoconductor material and developing of electrostatic images that will accomplish solid area development with a minimum use of developer material.

It is therefore the principal object of this invention to improve electrostatic reproduction machines for effecting high speed development of line copy and solid areas with a minimum of waste of the developing material.

Another object of this invention is to utilize a lamp and lamp control circuit for controlling the presence of electrostatic charged areas on a photoconductor plate just prior to entry into a development zone thereby controlling those areas to be developed.

Another object of this invention is to permit continuous operation of an electrostatic charging device in an electrostatic reproduction machine thereby allowing high speed operation thereof.

These and other objects of this invention are obtained by means of an elongated lamp positioned transverse to a moving photocondcutor plate immediately after the exposure station of an electrostatic reproduction machine. A control circuit is associated with the lamp and arranged to control its energization for dissipating charged areas on the plate at times when development is not desired.

For a better understanding of the invention as well as other objects and further features thereof, reference is had to the following detailed description of the invention to be read in conjunction with the accompanying drawings, wherein.

Figure 1:
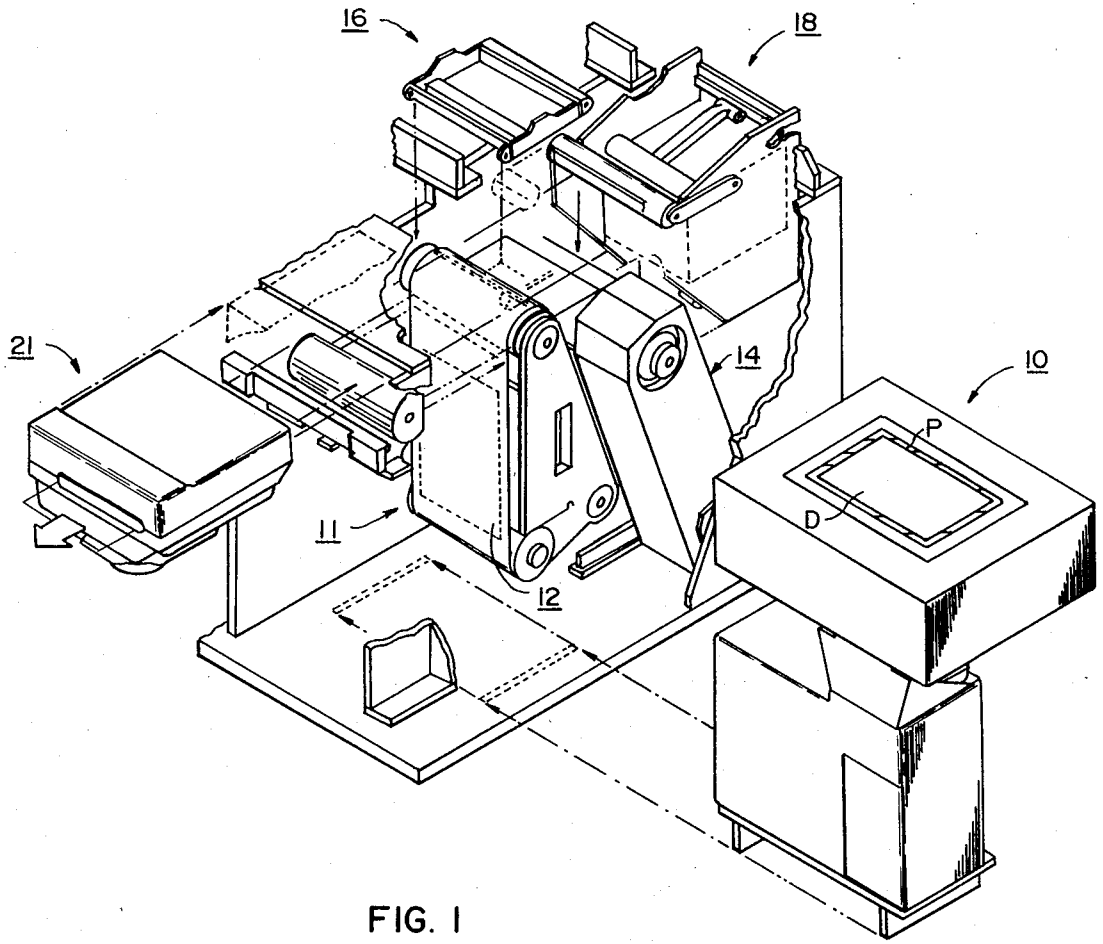
FIG. 1 is an exploded right-hand perspective view of a reproduction machine incorporating the present invention therein with processing components separated to better illustrate the environment for the present invention.
Figure 2:
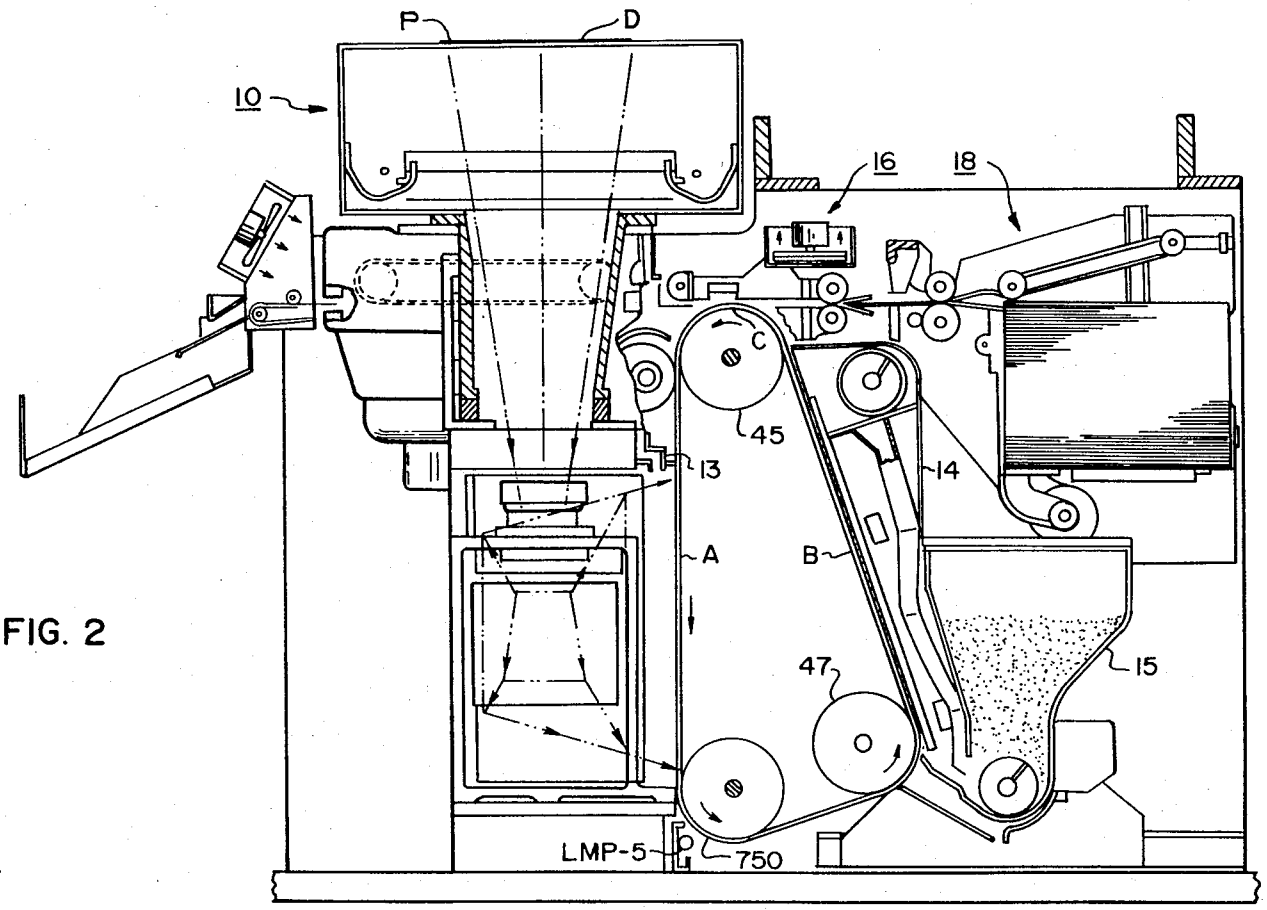
FIG. 2 is a schematic sectional view of the reproduction machine showing the various processing stations.
Figure 3:
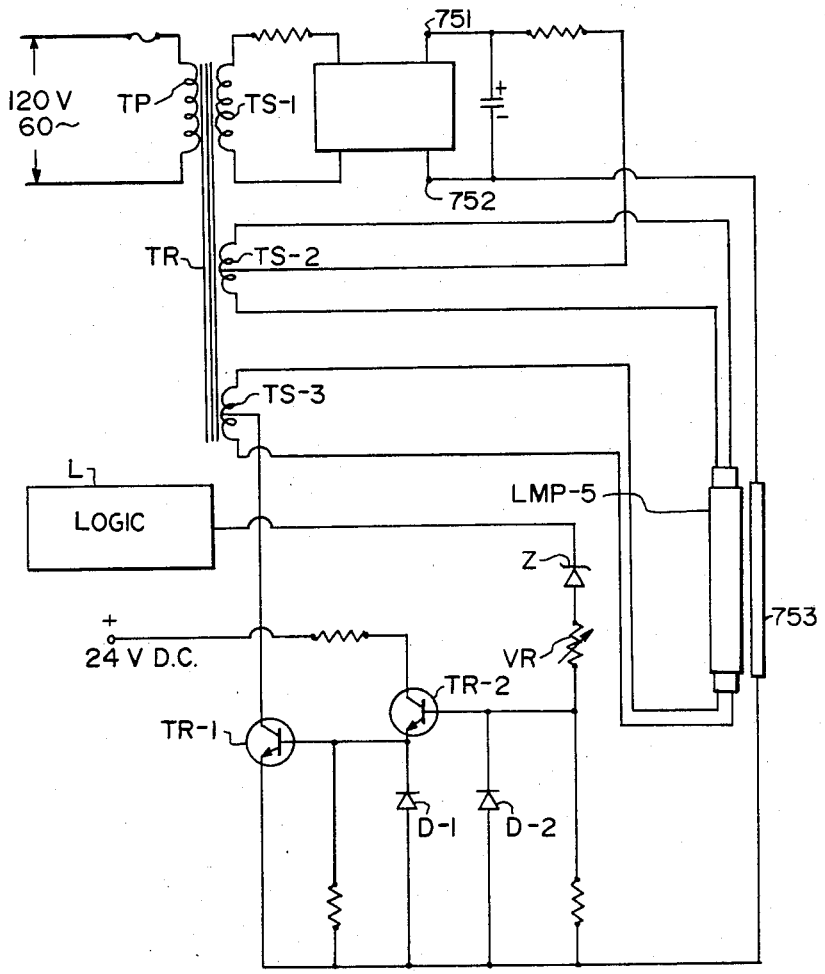
FIG. 3 is a schematic electrical diagram of a fade out lamp control system for achieving selective development in the illustrated xerographic machine.

For a general understanding of the illustrated copier/reproduction machine, in which the invention may be incorporated, reference is had to FIGS. 1 and 2 in which the various system components for a reproduction machine are schematically illustrated. As in all electrostatic systems such as a xerographic machine of the type illustrated, a light image of a document to be reproduced is projected onto the sensitized surface of a xerographic plate to form an electrostatic latent image thereon. Thereafter, the latent image is developed with an oppositely charged developing material to form a xerographic powder image, corresponding to the latent image on the plate surface. The powder image is then electrostatically transferred to a support surface to which it may be fused by a fusing device whereby the powder image is caused permanently to adhere to the support surface.

In the illustrated machine, an original to be copied is placed upon a transparent support platen P fixedly arranged in an illumination assembly generally indicated by the reference numeral 10, arranged at the left end of the machine. While upon the platen, an illumination system flashes light rays upon the original thereby producing image rays corresponding to the informational areas on the original. The image rays are projected by means of an optical system for exposing the photosensitive surface of a xerographic plate in the form of a flexible photoconductive belt arranged on a belt assembly generally indicated by the reference numeral 11.

The photoconductive belt assembly 11 is slidably mounted upon a support bracket secured to the frame of the machine and is adapted to drive a selenium belt 12 in the direction of the arrow as shown in FIG. 2 at a constant rate. During this movement of the belt, the reflected light image of an original on the platen is flashed upon the xerographic surface of the belt. The belt surface that intercepts the light rays comprises a layer of photoconductive material such as selenium on a conductive backing that is sensitized prior to exposure by means of a charging corona generator device indicated at 13.

The flash exposure of the belt surface to the light image discharges the photoconductive layer in the areas struck by light, whereby there remains on the belt a latent electrostatic image in image configuration corresponding to the light image projected from the original on the supporting platen. As the belt surface continues its movement, the electrostatic image passes through a developing station B in which there is positioned a developer assembly generally indicated by the reference numeral 14 and where the belt is maintained in a flat condition. The developer assembly 14 comprises horizontally and vertically conveying mechanisms which carry developing material to the upper part of the belt assembly 11 whereat the material is dispensed and directed to cascade down over the upwardly moving inclined selenium belt 12 in order to provide development of the electrostatic image.

As the developing material is cascaded over the xerographic plate, toner particles in the development material are deposited on the belt surface to form powder images. As toner powder images are formed, additional toner particles are supplied to the developing material in proportion to the amount of toner deposited on the belt during xerographic processing. For this purpose, a toner dispenser generally indicated by reference numeral 15 is used to accurately meter toner to the developer material in the developer assembly 14.

The developed electrostatic image is transported by the belt to a transfer station C whereat a sheet of copy paper is moved at a speed in synchronism with the moving belt in order to accomplish transfer of the developed image. There is provided at this station a sheet transport mechanism generally indicated at 16 adapted to transport sheets of paper from a paper handling mechanism generally indicated by the reference numeral 18 to the developed image on the belt at the station B.

After the sheet is stripped from the belt 12, it is conveyed into a fuser assembly generally indicated by the reference numeral 21 wherein the developed and transferred xerographic powder image on the sheet material is permanently affixed thereto. After fusing, the finished copy is discharged from the apparatus at a suitable point for collection externally of the apparatus.

Suitable drive means may be arranged to drive the selenium belt 12 in conjunction with timed flash exposure of an original to be copied, to effect conveying and cascade of toner material, to separate, and feed sheets of paper and to transport the same across the transfer station C and to convey the sheet of paper through the fuser assembly in timed sequence to produce copies of the original.

It is believed that the foregoing description is sufficient for the purposes of this application to show the general operation of an electrostatic copier using an illumination system constructed in accordance with the invention. For further details concerning the specific construction of the electrostatic copier, reference is made to copending application, Ser. No. 731,934 filed concurrently herewith in the name of Hewes at al, now matured into U.S. Pat. No. 3,661,452.

In order to effect development of the electrostatic latent image on the selenium belt 12, the development system for the xerographic reproduction machine, shown in FIG. 2, includes a developer assembly 14 (see FIGS. 3–16) which coacts with the selenium belt 12 at the development zone B. At this development zone, the charged exposed surface of the belt 12 is developed to form a powdered toner image of the original that was previously illuminated. For this purpose, the developer assembly 14 is mounted adjacent to the belt assembly 11 to establish the development zone B.

The xerographic machine previously described is adapted to copy originals and produce multiple copies thereof at a relatively high rate of speed. With provision for solid area coverage and a developing system which is adapted to supply toner particles to an electrostatic latent image in relatively high quantity, it is desirable that means be provided for controlling development either directly or indirectly in order to effect development only during those times in which a latent image is actually being processed. To this end there is provided with a selective development control arrangement, see FIGS. 2 and 3, which will selectively dissipate the charges upon the selenium belt during those periods in which an original has not been exposed which result in the formation of the narrow strips between electrostatic images moving upon the belt, the initial movement of the belt before the machine is conditioned to trigger the first exposure and during the production of the last copy immediately after the trailing edge thereof is being moved into the development zone of the machine.

Since the electrical inertia and hysteresis effects limit the "Off-On" response time for corotron energization, the charging corotron 13 for the xerographic machine remains "On" during the complete printing cycle operation for the machine. With the charging corotron continuously placing a solid charge upon the selenium belt, the development control circuit is arranged to dissipate the charge in those areas of the moving belt where exposure has not been provided in order to prevent development of these areas and consequently minimize the loss of toner particles occasioned by developing a solidly charged area of the belt.

The control circuit includes a discharge fluorescent lamp LMP-5 which is mounted in a suitable housing 750 secured to the base of the machine and arranged so that the lamp extends transversely across the path of movement of the selenium belt 12 after the same traverses the exposure station A.

The end coils for the lamp LMP-5 are connected respectively, to a secondary coil TS-2, TS-3 of a transformer TR. The primary TP for the transformer TR is connected to a suitable source of 120 volt 60 cycle electrical power. The transformer TR also includes a third secondary coil TS-1 which is adapted to step up the voltage and is connected to a full wave rectifier having positive and negative output terminals 751, 752, respectively. Preferably the output of the rectifier is approximately 300 volts d. c. and each of the secondaries TS-2, TS-3 capable of producing 6.3 volts.

With the two secondary windings being connected to the lamp coils as previously stated, the energization of the transformer primary TP will cause energization of the coils within the lamp tending to cause illumination thereof. However, with the center tap of the transformer secondary TS-2 being connected to the positive terminal 751 for the rectifier, the amount of energization provided for the lamp is sufficient to maintain the temperature of the gas therein at a sufficient temperature just below the threshold necessary to cause illumination thereof. This condition of the lamp LMP-5 is maintained during "standby" condition of the machine and in those periods when the lamp is not in illumination condition. The lamp circuit however is arranged such that with a proper input signal thereto additional energizing current is supplied to the two lamp coils in order to trigger the lamp to full illumination condition.

By maintaining the "standby" energization thereof just slightly below that voltage necessary to produce full illumination and allowing an extremely short duration pulse to trigger the lamp circuit to cause full illumination thereof, the pulse may be extremely short duration and the response time for the lamp to arrive at its full lumen output will become likewise extremely short. These time periods, that is, the duration of the input triggering signal and the response time in which the lamp achieves full illumination from a darkened or non-illumination condition and then reverts back again to a non-illumination condition can be measured in microseconds.

In order to accomplish this short duration illumination response time, the transformer secondary TS-3 has its center tap connected to the collector of a first transistor TR-1 which is normally maintained in a quiescent state. The emitter for this transistor is connected to the start shield 753 for the lamp LMP-5 and has its other end connected to the negative terminal 752 of the rectifier. Conduction of the transistor TR-1 will provide a small D. C. voltage to the start shield 753 in order to accomplish an additional triggering voltage to the lamp LMP-5 to effect the additional voltage bringing this lamp to fill illumination condition.

In order to control conduction of the transistor TR-1 the base thereof is connected to the emitter of a second transistor TR-2 having its collector connected to a source of D. C. current on the order 24 volts. The bases for the transistors are connected respectively by diodes D-1, D-2 to the connection between the emitter for the transistor TR-1 and the shield 753 in order to provide leakage compensation for the circuit. The transistor TR-2 is normally held in a non-conducting state, however, it is triggered into conduction by means of a pulse signal from the logic circuits indicated by the reference letter L for the xerographic machine to which the development control circuit may be applied. The signal is connected to the base of the transistor TR-2 by way of Zener diode Z and a variable resistor VR connected in series between the base of the transistor and the logic circuit. The pulse signal from the logic circuit is adapted to drive the transistor TR-2 thereby rendering the transistor TR-1 conductive for the D. C. power supply which supply is instantaneously connected to the shield 753 to provide the additional voltage for the lamp LMP-5 to produce full illumination thereof.

The machine logic L is arranged so that a pulse signal is generated for illuminating the lamp LMP-5 a short predetermined period of time after de-energization of the exposure lamps in the illumination system 10 for the xerographic machine. These occasions occur between each exposure on the selenium belt 12 which, in the event multiple copies of a single document are being made, is in the short interval that normally results in the spacing between the sheets being copied. The logic circuit L is also adapted to provide a continuous signal for the lamp LMP-5 during a time that the machine is turned "On" when belt charging and developer operation occur and just prior to the first illumination cycle of the system 10. Another time in which a continuous control signal is generated is after the short predetermined period of time after the last flash of illumination produced in the system 10 when belt charging and developer operation continues just prior to the time the machine goes into its shutdown mode. This short predetermined period of time referred is determined by the time required for the belt 12 to travel in order that an electrostatic image thereon is clear of the influence of the lamp LMP-5. In effect then, during multiple copy operation, the development control discharge lamp LMP-5 will be energized to discharge the portion of the drum moving past the lamp during those times that a latent image is not traveling past this lamp. These times occur for the spaces between copies and at the time that the trailing edge of the last copy has moved past the lamp and before the belt drive is terminated which occurs at shutdown condition of the machine. The discharge lamp will remain energized during a single copy operation until the machine assumes a shutdown mode in order to completely discharge the charged areas of the belt. During multiple copy operation, however, the discharge lamp will be energized only for short periods of time, those times between the trailing edge of one latent image and the leading edge of a succeeding latent image. These short periods of time would occur once a second in the event that the machine is producing one copy a second. After the last copy of a multiple series of copies have been made, the lamp will remain on until the selenium belt drive terminates and the d. c. corotron supply is de-energized.

During those times that the discharge lamp LMP-5 is illuminated, the uniform charge placed upon the selenium belt 12 by the charge corotron 13 is erased since the light exposure by the lamp LMP-5 will cause conduction of the photoconductor on the selenium belt. Upon each of these occurrences, the area of the belt affected by the lamp LMP-5 will not carry a charge and therefore will not be developed as these portions of the belt traverse the development station B. With this arrangement it will be apparent only those portions of the selenium belt which actually carry electrostatic latent images of information to be copied or reproduced will be treated at the development station B. At all other times especially during the start up of the machine and the terminating processing stations will not result in the full development of uniform charged areas which do not carry information to be reproduced. In this manner there is little loss of toner or developer material during a development process that is not necessary for machine use. With the provision of the control circuit the charging corotron 13 may be maintained in continuous energizing condition and the discharge lamp control will, in effect, provide that necessary "On-Off" requirement for determining whether the selenium belt will have or not have charged images thereon.

While there is in this application specifically described one form which the invention may assume in practice, it will be understood that this form of the same is shown for purposes of illustration, and that the invention may be modified and embodied in various other forms without departing from the scope of the appended claims.

What is claimed is:

1. In an electrostatic reproduction machine having a moving photoconductive plate adapted to be uniformly charged, document illumination means for producing an electrostatic latent image thereon, means for activating and deactivating the illumination means periodically for producing a plurality of latent images during a reproduction run and developing means positioned at a development zone to develop the moving electrostatic image on the plate, the combination with a discharge device adapted when activated to discharge a charged area on the plate when the area reaches a predetemined position in the travel, said device being positioned to discharge the charged area on the plate before the same enters the development zone, a control circuit associated with said discharge device, said control circuit being arranged for activating the discharge device immediately after the illumination means has been deactivated for discharging portions of the charged areas and thereby inhibit development of these areas.

2. In an electrostatic reproduction machine having a moving photoconductive plate adapted to be uniformly charged, document illumination means for producing an electrostatic latent image thereon, means for activating and deactivating the illumination means periodically for producing a plurality of latent images during a reproduction run and developing means positioned at a development zone to develop the moving electrostatic image on the plate, the combination with a discharge device adapted when activated to discharge a charged area on the plate when the area reaches a predetermined position in the travel, said device being positioned to discharge the charged area on the plate before the same enters the development zone, a control circuit associated with said discharge device, said control circuit being arranged for activating the discharge device immediately after each occurrence that the illumination means has been deactivated for discharging portions of the charged areas and thereby inhibit development of these areas.

3. In an electrostatic reproduction machine having a moving photoconductive plate adapted to be uniformly charged, document illumination means for producing an electrostatic latent image thereon, means for activating and deactivating the illumination means periodically for producing a plurality of latent images during a reproduction run and developing means positioned at a development zone to develop the moving electrostatic image on the plate, the combination with a discharge device adapted when activated to discharge a charged area on the plate when the area reaches a predetermined position in the travel, said device being positioned to discharge the charged area on the plate before the same enters the development zone, a control circuit associated with said discharge device, said control circuit being arranged for activating the discharge device immediately after the last occurrence that the illumination means has been deactivated in a reproduction run for discharging portions of the charged areas and thereby inhibit development of these areas.

* * * * *